United States Patent [19]

Massa

[11] 4,297,538

[45] Oct. 27, 1981

[54] RESONANT ELECTROACOUSTIC TRANSDUCER WITH INCREASED BAND WIDTH RESPONSE

[75] Inventor: Frank Massa, Hingham, Mass.

[73] Assignee: The Stoneleigh Trust, Cohasset, Mass. ; Fred M. Dellorfano, Jr. and Donald P. Massa, Trustees

[21] Appl. No.: 59,902

[22] Filed: Jul. 23, 1979

[51] Int. Cl.[3] ..... G08B 3/10; H04R 1/28; H04R 1/30

[52] U.S. Cl. ..... 179/180; 179/115 R; 181/159; 181/160; 181/192; 340/388

[58] Field of Search ..... 340/388; 179/115.5 H, 179/115 R, 110 A, 182 R, 179, 180; 181/159, 152, 182, 192, 177, 160; 310/322, 324, 335

[56] References Cited

U.S. PATENT DOCUMENTS

| | | | |
|---|---|---|---|
| 1,730,425 | 10/1929 | Harrison | 181/152 |
| 1,917,012 | 7/1933 | Blattner | 179/115.5 H |
| 3,517,390 | 6/1970 | Whitehead | 340/388 X |
| 3,846,792 | 11/1974 | Haigh | 340/388 X |
| 4,006,371 | 2/1977 | Quirke | 310/322 |
| 4,142,186 | 2/1979 | Sweany et al. | 340/388 |
| 4,176,731 | 12/1979 | Sinclair | 181/192 |

*Primary Examiner*—Thomas W. Brown

[57] ABSTRACT

An electroacoustic transducer which includes a vibratile diaphragm operating at resonance has its narrow band width response characteristic increased by an order of magnitude by the use of a uniquely designed acoustic coupler in combination with the resonant diaphragm. The acoustic resistane presented to the resonant diaphragm by the acoustic coupler dominates the motional impedance characteristic of the transducer in the resonant frequency region of the vibratile diaphragm. The use of the inventive acoustic coupler reduces the Q of the vibrating system from a value in the order of 30 or more to the order of 8 or less.

11 Claims, 8 Drawing Figures

RESONANT ELECTROACOUSTIC TRANSDUCER WITH INCREASED BAND WIDTH RESPONSE

This invention is concerned with means for increasing the band width of the response-frequency characteristic of an electroacoustic transducer in the vicinity of the resonant frequency of the vibratile diaphragm which is employed as part of the transducer vibrating system. The invention is particularly concerned with the improvement of the response characteristic of a transducer which employs a resonant diaphragm which is driven by an electromagnetic, piezoelectric, or other type of electromechanical energy transduction system. Although the invention may be used for improving the band width response of a resonant electroacoustic transducer designed for operating at any desired frequency region of the audio frequency spectrum, it is particularly advantageous for improving the operation of a resonant transducer designed for use in a frequency region located within the mid, upper audio or ultrasonic frequency range generally in the vicinity of 1 kHz or higher. Typical of the transducers whose performance is improved by this invention are the resonant bi-laminar diaphragm structures which comprise a thin ceramic piezoelectric disc bonded to one side of a metallic diaphragm whereby a low-cost flexural vibrating structure is achieved which is used in many commercial applications as a "beeper" for generating an audible signal in various appliances such as smoke alarms, intrusion alarms, electric alarm clocks, microwave ovens, and other similar applications.

A serious inherent limitation of the present conventional resonant diaphragm type transducers is that the response characteristic is confined to a very narrow band which makes it difficult and expensive to control the necessary uniformity in resonance among production units to avoid the variation in sensitivity that results as the resonant frequency changes among the transducers during their exposure to natural variations in the ambient conditions of use. Another limitation resulting from the narrow frequency band of the prior art conventional transducer is that it is not possible to use it to reproduce signals requiring a wide frequency band response such as, for example, is needed to generate a wailing or siren-type tone.

The primary object of this invention is to greatly reduce the motional impedance variation of a resonant electroacoustic transducer in the vicinity of resonance by making use of an acoustic coupler of unique design such as a specially designed Helmholtz resonator or exponential horn in combination with the resonant diaphragm, whereby the resistive loading presented to the vibratile diaphragm by the unique acoustic coupler dominates the motional impedance characteristic of the transducer in the resonant frequency region of the vibrating system, thereby greatly reducing the effective mechanical Q of the vibrating system and also achieving a higher efficiency over a wider band width than has been here-to-fore realized with previous resonant transducer designs.

Another object of the invention is to produce a more uniform resistive controlled motional impedance characteristic over an increased band width in the vicinity of resonance.

Still another object of the invention is to increase the band width of the frequency-response characteristic of a resonant electroacoustic transducer which resonates above 1 kHz, and to achieve a band width up to the order of one-quarter octave or more by providing a high acoustic resistance loading on the vibrating transducer element, whereby the mechanical Q of the vibrating system is reduced from a value in the order of 30 or more to the order of 8 or less.

Another object of the invention is to greatly increase the narrow band width response characteristic which is typical of a transducer employing a vibratile diaphragm operating at resonance above 1 kHz whose effective vibrating diameter is small compared with the wavelength at the operating resonant frequency, and whose reactance component of the motional impedance is much larger than the radiation component in the frequency region extending from 5% to 15% beyond the frequency of resonance.

This invention contemplates other objects, features, and advantages that will become more fully apparent from the following description taken in conjunction with the accompanying drawings which illustrate a preferred embodiment in which.

Figure 1:
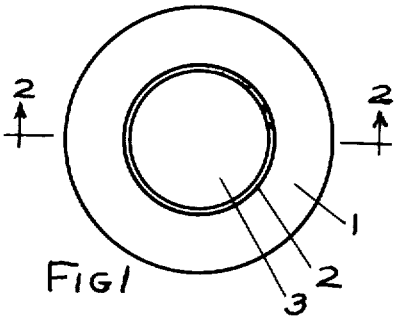
FIG. 1 is a plan view of a conventional low-cost resonant diaphragm-type transducer which operates in the 2 or 3 kHz region.
Figure 2:
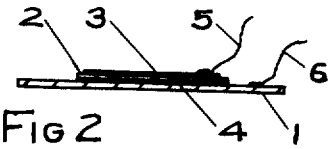
FIG. 2 is a cross-section taken along the line 2—2 in FIG. 1.

Referrring more specifically to the figures, the reference character 1 in FIGS. 1 and 2 illustrates a circular disc which is generally made of brass to which is bonded a polarized ceramic disc 2. The ceramic disc 2 has conducting electrode surfaces 3 and 4 applied to the opposite faces of the ceramic, as is well known in the art. Conducting cement, such as silver-filled epoxy, is used to cement the ceramic disc to the metallic diaphragm, and the conductors 5 and 6 are soldered to the electrode 3 and disc 1 to permit electrical connection to be made to the ceramic disc, as is also well known in the art. If a variable frequency voltage is applied to the conductors 5 and 6, the impedance appearing across the terminals as a function of frequency is illustrated by the curve A in FIG. 5. If the sound output from the transducer assembly is measured as a function of frequency for constant voltage applied to the electric terminals, the sensitivity as a function of frequency is illustrated by curve D in FIG. 6. These curves are typical of this type of transducer construction, as is well known in the art.

Figure 3:
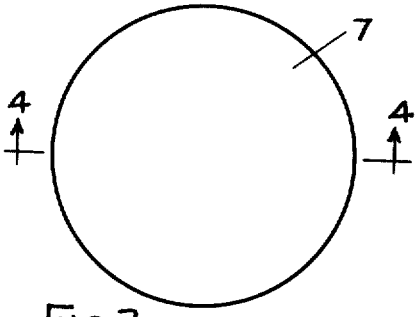
FIG. 3 is a plan view of another conventional type of low-cost resonant transducer employing a peripherally clamped diaphragm.
Figure 4:
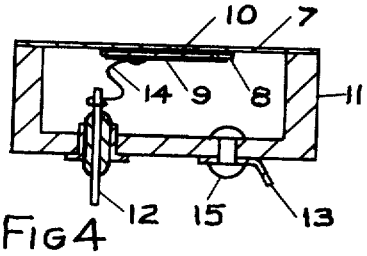
FIG. 4 is a cross-section taken along the line 4—4 in FIG. 3.

FIGS. 3 and 4 illustrate a modified version of the transducer described in FIG. 1. In this design, a metallic diaphragm 7 is similarly attached with conducting epoxy to a polarized ceramic disc 8, as previously described. A conductor 14 is soldered to the electrode surface 9, and then the structure is assembled to the housing 11, as illustrated in FIG. 4. The periphery of the diaphragm 7 is bonded with conducting epoxy to the end surface of the housing 11, as is well known in the art. The conductor 14 is soldered to the insulated terminal 12 before cementing the periphery of the diaphragm to the housing surface, as illustrated. A terminal 13 is attached to the housing 11 by a rivet to establish electrical connection through the housing and diaphragm to the contacting electrode surface 10 of the bonded ceramic 8, as shown.

Figure 5:
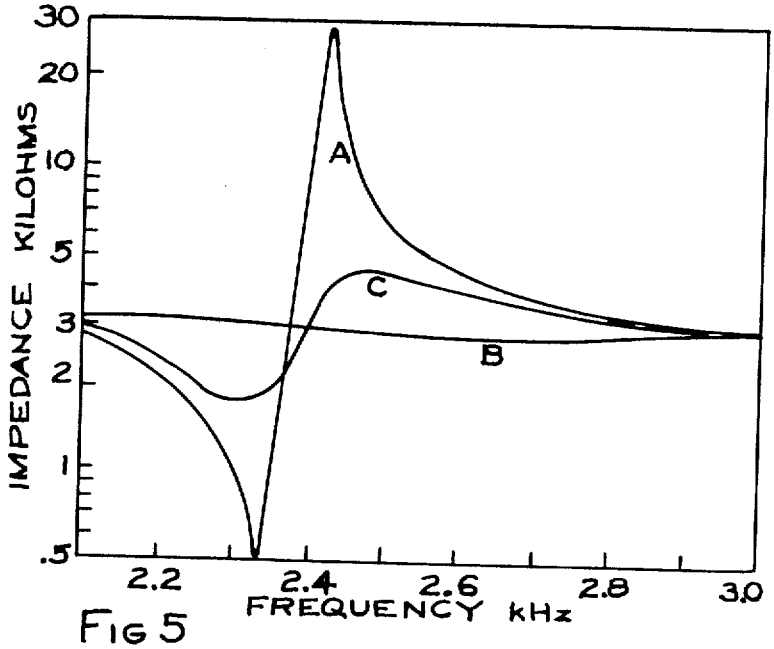
FIG. 5 is a motional impedance vs. frequency plot for a conventional resonant transducer with and without the inventive radiation resistance loading.
Figure 6:
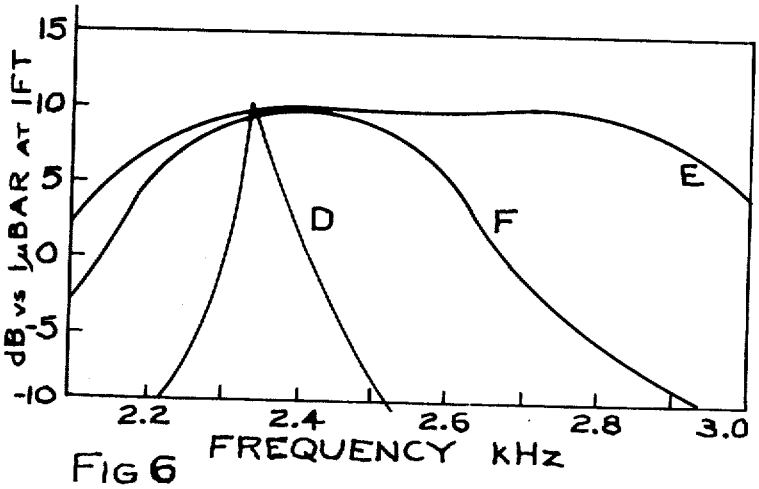
FIG. 6 is a frequency-response characteristic of a conventional resonant transducer with and without the inventive radiation resistance loading.

The transducer construction illustrated in FIG. 4 will also have a similar impedance curve, as shown by A in FIG. 5, and a similar response curve as shown by D in FIG. 6. The conventional resonant transducers as described have very large impedance variations in the vicinity of resonance which typically range in the order of 30 to 1 or more, and they also have very narrow frequency band response characteristics corresponding to values of Q in the neighborhood of 30 or more, as illustrated by curve D in FIG. 6. When these conventional transducers are used to generate warning signals, such as in smoke alarms and intrusion alarms, the sensitivity varies greatly, depending on the degree of synchronization of the frequency of the electrical drive signal with the resonant frequency of the transducer. To minimize the sensitivity variation, it is necessary to use feed-back circuits to sense the exact resonant frequency of the transducer at the particular instant and automatically adjust the frequency of the oscillator output to synchronize it with the transducer resonance. This procedure adds increased cost to the product. An additional disadvantage of the high Q narrow-band response is that it is not possible to drive the transducer with a variable frequency signal to produce a variable pitch siren-like warning tone because the sensitivity of the transducer will be greatly diminished at the off-resonance regions of the frequency sweep.

In order to eliminate these inherent disadvantages of the conventional resonant diaphragm transducer structures, I have found it possible to use an acoustic coupler of unique design to provide a resistive acoustic load on the peripherally clamped vibrating diaphragm of sufficient magnitude to damp the high acoustic reactance of the vibrating structure and at the same time achieve increased radiation efficiency. More important, the inventive acoustic coupler greatly increases the band width of the response characteristic so that high acoustic output is maintained over a several hundred percent increase in band width for the peripherally clamped vibratile diaphragm structure illustrated in FIG. 4, thereby permitting efficient broad band use of the inventive transducer to permit its successful operation with broadband signals to generate siren-type sounds which command greater attention as warning signals over the present use of single frequency tones.

Figure 7:
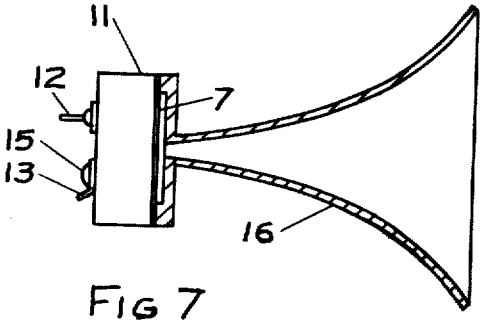
FIG. 7 is a schematic illustration of a horn design for use as an acoustic coupler for controlling the motional impedance characteristic of the vibratile diaphragm in the vicinity of resonance to achieve the teachings of this invention.

A schematic representation of one type of acoustic coupler to achieve the objects of this invention is illustrated in FIG. 7 and comprises a specially-designed exponential horn 16 having unique characteristics which are dictated by the desired increase in band width and by the physical constants of the resonant transducer illustrated in FIG. 4. During operation, the peripherally-clamped diaphragm illustrated in FIG. 4 has a maximum displacement at its center and the displacement gradually reduces to zero at the clamped periphery. As a result of the non-uniform displacement of the diaphragm surface, the total displacement of air during each oscillation of the peripherally-clamped diaphragm is equivalent to that of a piston operating at uniform maximum displacement with an area equal to approximately $\frac{1}{8}$ the total area of the clamped diaphragm. The effective mass of the vibratile diaphragm of FIG. 4 is approximately equal to $\frac{1}{3}$ the total mass at its clamped periphery. In order to provide sufficient acoustic damping to increase the band width to approximately $\frac{1}{4}$ octave, the radiation resistance presented to the diaphragm by the horn must be made approximately equal to the acoustic reactance of the vibratile diaphragm at $12\frac{1}{2}$% above and below the resonant frequency of the vibrating system. At resonance, the acoustic reactance is zero because the mass reactance of the diaphragm is equal in magnitude and opposite in phase to the stiffness reactance. Therefore, to achieve a band width of $\frac{1}{4}$ octave, which is 25% of the resonant frequency, the radiation resistance of the horn must be made approximately equal to the acoustic reactance of the vibratile diaphragm at $\pm 12\frac{1}{2}$% off the resonant frequency. At the resonant frequency, the acoustic mass reactance and acoustic stiffness reactance are equal. For the peripherally-clamped diaphragm, the acoustic mass reactance at resonance is given by the expression:

$$X_M = 2\pi fm/A^2 \text{ acoustic ohms} \quad (1)$$

where f = resonant frequency m = effective mass of diaphragm in gms.

$m = m_o/3$ $m_o$ = total diaphragm mass

A = effective area of diaphragm in sq. cm.

$A = A_o/3$ $A_o$ = total diaphragm area $= \pi D^2/4$

D = clamped diameter of diaphragm in cms.

Substituting the values $m_o$ and $A_o$ in equation (1) gives:

$$X_M = \frac{30\, fm_o}{D^4} \text{ acoustic ohms} \quad (2)$$

At $\pm 12\frac{1}{2}$% off the resonant frequency, the mass reactance and stiffness reactance both change by $12\frac{1}{2}$%, thus making the total reactance, $X_T$, of the vibrating diaphragm at $12\frac{1}{2}$% off the resonant frequency equal to 0.25 $X_M$ which becomes:

$$X_T = \frac{7.5\, fm_o}{D^4} \text{ acoustic ohms} \quad (3)$$

The acoustic resistance, R, at the throat of an exponential horn whose mouth diameter exceeds $\frac{1}{2}$ wavelength of the radiated sound is equal to:

$$R = \frac{42}{A_t} \text{ acoustic ohms} \quad (4)$$

where $A_t$ = area of throat in sq. cm.

In order to achieve one object of this invention to increase the band width of the response characteristic of the resonant diaphragm to approximately $\frac{1}{4}$ octave, I have found that the area of the throat of the exponential horn needed to provide the necessary damping must be determined by equating equations (3) and (4) which gives the required approximate area for the horn throat as:

$$A_t = \frac{5.6\,D^4}{fm_o} \text{ sq. cm.} \quad (5)$$

An experimental transducer was built as illustrated in FIG. 4 with the following constants: f=2400 Hz, $m_o$=2 gm., and D=3.8 cms. Substituting these constants into equation (5) gives a value for $A_t$=.24 sq. cm. which represents a throat diameter slightly less than ¼ inch for an exponential horn having the inventive characteristics to act as an acoustic coupler for increasing the band width of the response characteristic of the vibratile diaphragm to achieve the stated object of this invention. An exponential horn was built with a throat diameter equal to ¼ inch and a mouth diameter equal to 4 inches. The actual measured response characteristic of the transducer in combination with the inventive horn just described is shown by curve E in FIG. 6. The band width of the response characteristic at the −3 dB sensitivity points is approximately 750 Hz, which is about 1900% increase in band width from 40 Hz, as shown by curve D in FIG. 6 for the transducer alone. The motional impedance of the transducer plus horn combination is shown by curve B in FIG. 5 which indicates a very small variation in the vicinity of the resonance frequency of the vibratile diaphragm as compared with curve A without the horn. It should also be noted that all the response curves in FIG. 6 were obtained with 1 volt drive, and since the impedance at the frequency of peak sensitivity for curve D is 500 ohms compared with 3000 ohms for the response curve E, which shows the sensitivity with the attached inventive horn, the efficiency of the resonant transducer with the added specially-designed horn is increased 600% over the peak efficiency of the vibratile diaphragm alone (curve D).

The approximate size of the inventive horn throat is determined from equation (5). I have found that in practice the horn throat area can be varied over a range from one-half to double the value given by equation (5) and the design will remain well within the limits of the teachings in this invention.

Figure 8:
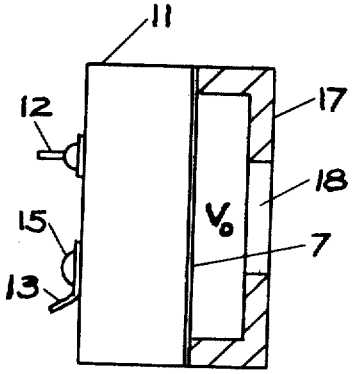
FIG. 8 is a schematic illustration of a Helmholtz resonator design for use as an acoustic coupler to achieve the teachings of this invention.

Another type of acoustic coupler that can be used for increasing the acoustic resistance loading on the vibratile diaphragm to achieve the objects of this invention is illustrated in FIG. 8. A housing structure 17 is sealed to the outer peripheral surface of the vibratile diaphragm 7 by means of epoxy cement or other suitable means, as illustrated in FIG. 8. The sealed housing structure 17, in combination with the opening 18, forms a Helmholtz resonator having an enclosed volume $V_o$cc and an opening of area $A_c$ sq. cms. If the combination of the volume $V_o$ with the area of the opening is chosen to result in a resonance frequency for the Helmholtz resonator in the vicinity of the resonance frequency of the vibratile diaphragm, a large increase in acoustic resistance loading can be achieved, sufficient to increase the band width 500% to 1000%, provided the area of the opening 18 is chosen within the approximate range ½ to 150 the area of the diaphragm as measured at its clamped periphery. It is also necessary to make the linear dimension between the diaphragm surface and the opposite inside wall of said Helmholtz resonator less than ¼ wavelength at the resonant frequency of the diaphragm. An experimental housing structure 17 was constructed in which the area of the opening 18 was made ¼ the area of the diaphragm, and the volume $V_o$ was adjusted to resonate with the opening at the resonant frequency of the diaphragm. The measured motional impedance characteristic of the assembly is shown by curve C in FIG. 5, and the response characteristic is shown by curve F in FIG. 6. The band width indicated for curve F is 350 Hz which is 800% increase in band width as compared with a 40 Hz band width indicated by Curve D which is the response for the same transducer without the use of the inventive acoustic coupler.

The acoustic loading which can be achieved with the exponential horn designed as described above is greater than can be realized with the use of the Helmholtz resonator design as described. The reduced variation in the motional impedance characteristic achieved with each type of acoustic coupler is shown by comparing curves B and C with curve A in FIG. 5. The greatly improved band width in the response characteristic that is achieved by both types of acoustic couplers, designed as taught in this patent application, is shown by comparing curves E and F with curve D in FIG. 6.

While a few specific embodiments of the present invention have been shown and described, it should be understood that various additional modifications and alternative constructions may be made without departing from the true spirit and scope of the invention. Therefore, the appended claims are intended to cover all such equivalent alternative constructions that fall within their true spirit and scope.

I claim:

1. In combination in an electroacoustic transducer including a peripherally-clamped vibratile diaphragm and electromechanical transducer means associated with said diaphragm for converting alternating electrical signals into mechanical vibrations, said peripherally-clamped diaphragm characterized in that its fundamental resonant frequency is greater than 1 kHz, and further characterized in that the clamped diameter of said diaphragm is less than one-half wavelength of the sound generated at said resonant frequency, said electroacoustic transducer characterized in that the band width of the frequency response characteristic in the vicinity of resonance is relatively narrow and is equivalent to a Q factor greater than 20, means for substantially increasing the band width of the response characteristic of said transducer such that the Q factor is reduced to a value less than 8, said means for increasing the band width includes means for damping the acoustic reactance of the peripherally-clamped vibratile diaphragm over a frequency range extending at least ±10% beyond the resonant frequency of said transducer, said damping means characterized in that the damping is not in the form of a mechanical resistance which adds viscosity loss to the vibrating diaphragm, but that said damping is in the form of increased acoustic radiation resistance added to the vibrating diaphragm by means of an acoustic coupler interposed between the radiating surface of said vibratile diaphragm and the medium into which the acoustic energy is radiated.

2. The invention in claim 1 characterized in that said acoustic coupler comprises a walled chamber enclosing a specified volume of air, two openings provided through the walls of said chamber, the first of said openings includes means for attaching said electroacoustic transducer to seal said opening, said first opening characterized in that it provides unobstructed passage of the air vibrations set in motion by said vibratile diaphragm into said chamber, said second opening in said chamber characterized in that the area of said second opening lies within the range ½ to ⅛ the area of said vibratile diaphragm at its clamped periphery.

3. The invention in claim 2 characterized in that the resonant frequency of said enclosed volume of air in said chamber in combination with the area of said second opening is approximately equal to the resonant frequency of said vibratile diaphragm.

4. The invention in claim 3 further characterized in that the linear dimension between the surface of said vibratile diaphragm and the opposite inside wall surface of said chamber is less than ¼ wavelength of the sound radiated into the medium at the resonant frequency of the transducer.

5. The invention in claim 1 characterized in that said acoustic coupler is an exponential horn.

6. The invention in claim 5 further characterized in that the acoustic resistance presented by the throat area of said exponential horn is equal to the acoustic reactance of said vibratile diaphragm at a frequency within the region between 5% and 15% removed from the resonant frequency of said vibratile diaphragm.

7. The invention in claim 5 characterized in that the throat area of said exponential horn lies within the range ½ to twice the value given by the expression.

$$A_t = \frac{5.6\,D^4}{f m_o} \text{ sq. cm.}$$

where:

$A_t$ = throat area

D = diameter of vibratile diaphragm at its clamped periphery in cm.

f = resonant frequency of the vibratile diaphragm in Hz $m_o$ = total mass of the vibratile diaphragm in gms.

8. The invention in claim 6 characterized in that the mouth diameter of said exponential horn is greater than ½ wavelength of the sound being radiated over the frequency band of operation of said vibratile diaphragm.

9. The invention in claim 7 characterized in that the mouth diameter of said exponential horn is greater than ½ wavelength of the sound being radiated over the frequency band of operation of said vibratile diaphragm.

10. In combination in an electroacoustic transducer including a vibratile diaphragm and electromechanical transducer means associated with said diaphragm for converting alternating electrical signals into mechanical vibrations, said vibratile diaphragm characterized in that its fundamental resonant frequency is greater than 1 kHz, said electroacoustic transducer characterized in that the band width of the frequency response characteristic in the vicinity of resonance is relatively narrow and is equivalent to a Q factor greater than 20, means for substantially increasing the band width of the response characteristic of said transducer such that the Q factor is reduced to a value less than 8, said means for increasing the band width includes means for damping the acoustic reactance of the vibratile diaphragm over a frequency range extending approximately ±10% beyond the resonant frequency of said transducer, said damping means characterized in that the damping is not in the form of a mechanical resistance which adds viscosity loss to the vibrating diaphragm but that said damping is in the form of increased acoustic radiation resistance added to the vibrating diaphragm by means of an acoustic coupler interposed between the radiating surface of said vibratile diaphragm and the medium into which the acoustic energy is radiated.

11. The invention in claim 10 characterized in that the magnitude of the acoustic radiation resistance added to the vibratile diaphragm is greater than the magnitude of the acoustic reactance of said vibratile diaphragm at a frequency removed 5% from the resonant frequency of the said diaphragm.

* * * * *